US005240193A

United States Patent [19]

Backhaus

[11] Patent Number: 5,240,193

[45] Date of Patent: Aug. 31, 1993

[54] APPARATUS FOR SUPPLYING AN AUTOMATIC BOBBIN WINDER WITH COPS MOUNTED UPSTANDING ON CARRIERS

[75] Inventor: Jürgen Backhaus, Wegberg, Fed. Rep. of Germany

[73] Assignee: W. Schlafhorst AG & Co., Moenchengladbach, Fed. Rep. of Germany

[21] Appl. No.: 902,708

[22] Filed: Jun. 23, 1992

[30] Foreign Application Priority Data

Apr. 3, 1992 [DE] Fed. Rep. of Germany ..... 4211112

[51] Int. Cl.[5] ..... B65H 67/06

[52] U.S. Cl. ..... 242/35.5 A

[58] Field of Search ..... 242/35.5 A, 35.5 R, 242/18 R

[56] References Cited

U.S. PATENT DOCUMENTS 4,545,551 10/1985 Uchida et al. ..... 242/35.5 A
4,566,644 1/1986 Kiriake ..... 242/35.5 A
4,576,341 3/1986 Matsui et al. ..... 242/35.5 A
5,056,725 10/1991 Wirtz et al. ..... 242/35.5 A
5,078,329 1/1992 Grecksch et al. ..... 242/35.5 A

*Primary Examiner*—Stanley N. Gilreath
*Attorney, Agent, or Firm*—Shefte, Pinckney & Sawyer

[57] ABSTRACT

Apparatus for supplying cops mounted upstanding on caddies, peg trays, or other carriers to the winding heads of an automatic bobbin winder has a cop distributing conveyor common to all winding heads, a main cop delivery conveyor parallel to the distributing conveyor, and plural secondary delivery conveyors branching from the main delivery conveyor to the distributing conveyor at infeed positions which are correspondingly spaced along the distributing conveyor. A first infeed position is located, in relation to the direction of travel of the distributing conveyor upstream of a first winding head, while the last infeed position is located upstream of a last group of the winding heads.

9 Claims, 2 Drawing Sheets

APPARATUS FOR SUPPLYING AN AUTOMATIC BOBBIN WINDER WITH COPS MOUNTED UPSTANDING ON CARRIERS

BACKGROUND OF THE INVENTION

The present invention relates generally to bobbin winding machines and, more particularly, to apparatus for conveying cops mounted upstanding on carriers such as caddies or peg trays to multiple winding heads of a bobbin winding machine.

Automatic bobbin winders having cop transport systems in which peg trays or other carriers mounted with cops are circulated have long been known, e.g., as disclosed in Japanese Patent Document JP-AS 49-12128. The cops remain mounted on the peg trays during the unwinding operation and also during transport away from the winding head as an empty tube. This Japanese publication also teaches a conveyor belt guided along the bobbin winding machine for the purpose of delivering the peg trays to all winding heads. The delivery of the caddies to the storage stretches of the winding heads takes place by means of controllable loading devices. The peg trays are delivered to the conveyor belt only as needed.

German Published Patent Application DE-OS 33 08 172 also teaches a bobbin winding machine which exhibits the essential features of the bobbin winding machine already described. However, no separately controllable loading devices are present but rather fixed guide plates deflect all individual carriers arriving on the cop carrier conveyor belt in the direction of the storage stretches associated with the winding heads of the machine. These guide plates, in conjunction with the shaping of delivery stretches extending to the winding heads, permit a deflection of caddies or peg trays only in one direction of travel along the cop carrier conveyor belt, which forms a distributing stretch along the bobbin winding machine. For this reason, in view of the fact that caddies or peg trays are regularly delivered to the conveyor belt, not merely when there is a particular determined requirement of the winding heads, care must be taken that peg trays or caddies arriving at the end of the conveyor belt and not received by the delivery stretches to the winding heads do not accumulate or back up, which could ultimately result in a blocking of the entire delivery of cops to the winding heads. To this end, an additional return track parallel to the distributing stretch formed by the cop carrier conveyor belt is provided for returning the excess caddies or peg trays to the entrance of the carrier conveyor belt.

An undersupplying of cops to the winding heads located at one end of the distributing stretch of the conveyor can occur, especially if short rewinding times of the cops necessitate a frequent cop replacement. Cops arriving at the entrance end of this distributing stretch are therefore taken up relatively rapidly by the closer winding heads, so that fewer or no caddies or peg trays arrive at the more distant winding heads. This also results from the fact that the specific track guide imposes limits on the transport speed of the caddies or peg trays on the distributing stretch.

SUMMARY OF THE INVENTION

The present invention therefore has the object of providing an apparatus for supplying carrier-mounted cops to an automatic bobbin winder which assures a sufficient supplying of the entire automatic bobbin winder even in the case of short cop unwinding times.

Basically, the present invention provides an improvement in apparatus of the type adapted for supplying textile cops mounted in upstanding disposition on carriers, such as peg trays or caddies, to a plurality of winding heads of an automatic bobbin winder, wherein a cop carrier distributing arrangement utilizing a conveyor belt forms a continuous transport section common to all of the winding heads. A plurality of cop carrier storage paths extend between the cop carrier distributing arrangement and the winding heads to communicate the winding heads with the distributing arrangement, each storage path being adapted for receiving a predetermined number of cop carriers and to prevent receipt of additional carriers when full whereby additional carriers continue transportation on the distributing arrangement, and a cop carrier return arrangement is communicated with a terminal end of the distributing arrangement for return transport of cop carriers not received by the storage paths in the opposite direction to the direction of transport of the distributing arrangement and for feeding the returned cop carriers back to the distributing arrangement at an upstream location.

Briefly summarized, according to the present invention, a main cop carrier delivery arrangement extends parallel to the distributing arrangement and a plurality of secondary delivery arrangements branch from the main delivery arrangement to the distributing arrangement at respective infeed positions spaced along the distributing arrangement. A first such infeed arrangement is located, in relation to the direction of transport of the conveyor belt of the distributing arrangement, upstream of a first one of the winding heads, while a last one of the infeed positions is located upstream of a last group of the winding heads.

The arrangement of several branch secondary delivery arrangements spaced in an appropriate manner along the distributing arrangement insures a sufficient supply of carrier-mounted cops to the entire automatic bobbin winder at all times, even at the start of the winding process. Thus, cop-mounted carriers arrive at the several infeed positions arranged along the distributing arrangement at the same time for transfer onto the transport section of the distributing arrangement which is common to all winding heads. As a result thereof, the paths which the carriers must traverse on this distributing arrangement to reach the winding heads are considerably shortened. It therefore causes no problems to use a low traveling speed for transporting carriers on the distributing arrangement which promotes a smooth delivery of the carriers to the winding heads.

In addition, given a speed on the delivery arrangement which is distinctly greater than that of the distributing arrangement, the carriers also move more rapidly into the distal end area of the automatic bobbin winder. The arrangement of the first infeed position from the delivery arrangement to the distributing arrangement upstream of the first winding head is necessary in order to also be able to supply the adjacent winding heads located along the upstream-most beginning of the distributing arrangement, because of the constant direction of transport on the distributing arrangement. The arrangement of the last infeed position from the delivery arrangement to the distributing arrangement at a sufficient upstream distance from the last winding head serves the purpose of reducing the number of carriers which must be returned back to the distributing arrangement and thereby avoids an unnecessary storage of carriers. The total number of carriers circulating in the system can be limited to a minimum in this manner.

In a preferred embodiment of the present invention, the main cop carrier delivery arrangement is set up for transport of cop carriers thereon in a direction corresponding to the direction of transport of the conveyor belt of the distributing arrangement. As a result, the delivery arrangement is not required to extend to the end of the distributing arrangement.

It is additionally preferred that sensors and shunts be associated with at least one of the secondary delivery arrangements for selectively diverting carriers onto the secondary delivery arrangement or preventing carriers from being received by the secondary delivery arrangement in predetermined numbers to achieve a uniform distribution of the carriers to the distributing arrangement. This arrangement of sensors and shunts at the branching secondary delivery arrangements achieves an effective distribution of the carriers to the distributing arrangement. The sensors and shunts preferably are connected to and controlled by a central control unit. In the normal instance, i.e., where the infeed positions are arranged at the same distance from each other, a uniform distribution of carriers onto the branching secondary delivery arrangements should be carried out, whereas in the case of unequal spacings between the infeed positions, the division of carriers to the secondary delivery arrangements must take place in relation to the relative distances between the infeed positions. It is insignificant under the present invention whether the selective shunting of the carriers onto the branching secondary delivery arrangements is controlled for each carrier individually or in groups of successive carriers.

The present invention contemplates that the cop return arrangement is communicated with the overall cop delivery system to return thereto excess carriers which are not taken up by any winding head storage path. The most space-saving variant is to arrange the return arrangement to communicate with and transfer returning carriers directly to the last branching secondary delivery arrangement from the main delivery arrangement. Alternatively, or in addition, the return arrangement may be arranged to communicate with and transfer returning carriers to the main delivery arrangement at a location upstream of the first secondary delivery arrangement. In embodiments where the return arrangement communicates with both the main delivery arrangement and the last secondary delivery arrangement, a shunting arrangement is provided to selectively shunt returning carriers to the two return locations. The number of returning carriers may be counted in relation to elapsed time, e.g., by means of a sensor connected to the central control unit, to prevent an oversupply of carriers to the terminal end section of the distributing arrangement by altering the control of the shunting arrangement to supply relatively fewer carriers to the last secondary delivery arrangement when a predetermined value of the time-related count of returning carriers is exceeded.

Cop preparation units may also be arranged at the branching secondary delivery arrangements to increase the delivery capacity of the carriers to the bobbin winding machine. This feature of the invention can be significant, especially if the cop unwinding times are in a relatively short range, e.g., between one and two minutes, due to the small size of the cops. A central cop preparation device for a bobbin winding machine with, for example, sixty winding heads would hardly allow a sufficient supply of fresh cops to the winding heads in this circumstance. At the least, a necessary shortening of the cycle time in the cop preparation device would result in an increase of improperly prepared cops.

DESCRIPTION OF THE PREFERRED EMBODIMENT

Figure 1:
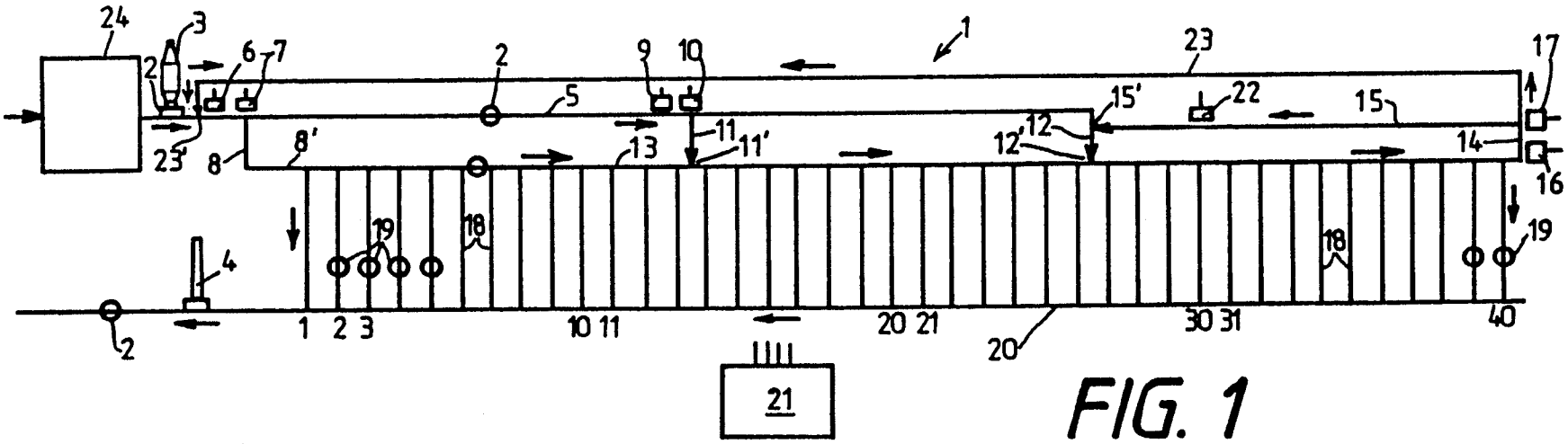
FIG. 1 shows a schematic plan view of a bobbin winding machine equipped with a cop supplying apparatus in accordance with one preferred embodiment of the present invention.

Referring now to the accompanying drawings and initially to FIG. 1, a bobbin winding machine is shown generally at 1 and comprises a closed conveyor circuit for transporting cop caddies or peg trays on which cops 3 are mountable in upstanding disposition. The cop transport paths located at the head end of the bobbin winding machine 1 are not shown since they have no significance with respect to the present invention. Their design is well known from German Patent DE 39 19 542 A1.

This closed cop circulating system always maintains the number of circulating caddies 2 constant, which assures a constant supply of the bobbin winding machine with fresh cops in accordance with the machine requirements without additional regulating mechanisms. This result is achieved by the fact that caddies only arrive at a cop supply station for the receiving of fresh cops if a cop has been unwound previously. For reasons of clarity, only a representative few of the caddies or peg trays 2 are illustrated in the drawings.

The bobbin winding machine 1 is itself of a substantially conventional construction, having a plurality of winding stations or heads 19 arranged permanently on a machine in spaced alignment adjacent one another lengthwise along the machine, as representatively indicated in the drawing and consecutively numbered as reflected by 1, 2, 3, 10, 11, 20, 21, 30, 31 and 40.

A common main delivery conveyor 5 for all caddies or peg trays 2 carrying cops 3 extends over a large lengthwise portion of automatic bobbin winder 1. Secondary delivery conveyor paths 8, 11, and 12 branch from the common conveyor 5. These branch secondary conveyor paths 8, 11, and 12 discharge at infeed positions 8', 11', and 12' into a distributing path 13. The last branch conveyor path 12 begins at the end of the delivery conveyor 5, so that the extent of the main delivery conveyor downstream of the location of the branch delivery conveyor path 11 may be considered to constitute a branch conveyor path.

The infeed positions 8', 11', and 12' of the branch conveyor paths 8, 11, and 12 are each located according to FIG. 1 at the beginning of sections of the distributing path 13 of automatic bobbin winder of approximately equal length and encompassing approximately equal numbers of winding heads 19. It is therefore advantageous for an effective distribution of the caddies 2 to the winding heads 19 of the automatic bobbin winder 1 if all three branch conveyor paths 8, 11, and 12 are supplied with approximately equal numbers of cop-mounted caddies. This result is achieved by means of shunts 7 and 10 located respectively at the entrances to the branch delivery conveyor paths 8 and 11, which shunts 7,10 are connected to and controlled by a central control unit 21. Sensors 6 and 9 are respectively located along the main delivery conveyor 5 immediately upstream of the shunts 7,10. These sensors 6,9 are also connected to the central control unit 21 and individually operate to signal the passage of a caddy 2 mounted with a cop 3 along the delivery conveyor 5 past their respective positions.

In the described spacing of the infeed positions 8', 11', and 12', the control of the shunts 7,10 could be accomplished by the central control unit 21 in such a manner that the shunt 7 diverts every third caddy 2 mounted with a cop 3 to the branch conveyor path 8, while allowing all other caddies 2 to continue travel along the main delivery conveyor 5. The shunt 10, at which only two-thirds of caddies 2 would then arrive, would then be controlled by the central control unit 21 in such a manner that it would alternatingly shunt every other caddy to the branch conveyor path 11 and allow every intervening caddy 2 to continue to travel along the main delivery conveyor 5 to the branch conveyor path 12 and then to its infeed position 12'. It is also of course contemplated that this division of caddies 2 may be performed in groups of successive caddies in order to reduce the frequency of switching the shunts 7,10. An analogous procedure should be employed if a differing larger or smaller number of branching secondary delivery conveyor paths is present. Further, if the relative spacing of the infeed positions of the branching secondary delivery conveyor paths is varied from that of FIG. 1, i.e., if different distances or different numbers of winding heads are present between the infeed positions, a correspondingly differing division of the caddies 2 among the branch conveyor paths should likewise accordingly take place. In each case, the distribution of caddies should be controlled in such a manner that the number of caddies supplied to each branch conveyor path corresponds to the length of the section of the distributing path 13 located downstream of and supplied by the respective infeed position between it and the next succeeding infeed position along the distributing path.

In the embodiment of an automatic bobbin winder 1 shown in FIG. 1, a cop preparation device 24 is located at the beginning of the main delivery conveyor 5 which prepares all cops 3 to be rewound in the automatic bobbin winder. Such cop preparation devices are known, e.g., as described in German Patent Document DE 33 08 172 A1, and accordingly their design and operation need not be discussed in more detail herein.

Figure 2:
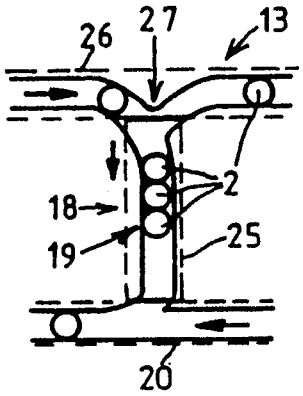
FIG. 2 shows a schematic plan view, enlarged in comparison to FIG. 1, of the intersection of the common distributing conveyor belt and one of the storage paths which are present at each winding head.

FIG. 2 representatively shows the area of the overall caddy transport system associated with each winding head 19 in greater detail than FIG. 1. As can be seen, the cop distributing path 13 is defined by a conveyor belt 26 traveling along the length of the winding machine 1 to supply caddies 2 successively to individual caddy storage paths 18 extending transversely from the conveyor belt 26 at each winding head 19. Each transverse caddy storage path 18 extends through and includes the position at its respective winding head 19 at which a caddy 2 is situated during the unwinding of its supported cop 3 by the winding head 19.

The caddies 2 are caused to travel along distributing path 13 by frictional entrainment by the conveyor belt 26 while being guided by lateral guide plates extending along opposite lateral sides thereof. Baffles 27 are arranged at spacings along the distributing path 13 at the location of each transverse caddy storage path 18 for changing the direction of transport of the caddies, i.e., by shifting them transversely to the direction of travel of the conveyor belt 26 in the direction of the particular caddy storage path 18. This action of the baffles 27 causes the caddies 2 to be delivered into a position overlying the respective caddy storage paths 18, each of which comprises a conveyor belt 25, which belt 25 can then frictionally entrain the particular caddy 2 and transport it along the caddy storage path 18 to the respective winding head 19. If a caddy storage path 18 is fully occupied by a series of caddies 2, caddies arriving on the distributing path 13 continue to be entrained by its conveyor belt 26 and are guided back around the baffle 27, with the assistance of the internal guides, to rest completely on and continue travel with the conveyor belt 26 again.

In the drawing of FIG. 2, the caddy-storage state of the illustrated storage path 18 is such that, after the transfer of the next arriving caddy onto the storage path 18, the path 18 will be fully occupied by caddies. The storage path 18, as illustrated, thus has a total capacity to receive one caddy 2 located in active unwinding position at the winding head 19 and three other caddies 2 standing in a waiting position.

The terminal end of each transverse supply path 18 downstream of its winding head 19 communicates with an empty tube return conveyor 20. Caddies 2 whose supported cops have been unwound and are now empty tubes 4 conveyed by the supply conveyor belt 25 and transferred to the tube return conveyor 20. The empty tube return conveyor 20 travels in a direction opposite to that of the delivery conveyor 5 and the distributing conveyor 26. Thus, all caddies 2 with empty tubes 4 which are ejected from the plural winding heads 19 are then conveyed by the tube return conveyor 20 back to the same end of the automatic bobbin winder 1 from which the cop-mounted caddies 2 originated, whereat a replacement of the empty tubes 4 by new cops 3 can then take place.

As is apparent from the illustration of FIG. 2, no special control mechanism or means is necessary for the transfer of caddies 2 mounted with cops 3 onto the transverse storage paths 18. Caddies 2 transported on the distributing conveyor belt 26 are always guided and conveyed automatically beyond each transverse storage path 18 which is already fully occupied by caddies 2 standing in the reserve positions. This arrangement naturally does not necessarily avoid the possibility that some caddies 2 will still be conveyed completely to the end of distributing path 13 without having been transferred to any of the transverse storage paths 18. In order to avoid an accumulation or backup at the terminal end of the automatic bobbin winder 1, an overflow path 14 directly follows and communicates with this end of the distributing path 13 and in turn merges into a cop carrier return conveyor path 23 which extends to the opposite end of the automatic bobbin winder 1 whereat the carrier return conveyor 23 communicates with the main delivery conveyor 5 at an infeed position 23' upstream of the first branch delivery conveyor path 8 for return of excess cop-mounted caddies 2 back onto the delivery conveyor 5. This return conveyor 23 travels in the direction opposite to that of the distributing path 13. By means of this return conveyor 23, such excess cop-mounted caddies 2 can be re-conveyed along the delivery and distribution conveyors 5,26 for distribution to the winding heads 19.

In addition, another return conveyor path 15 branches from the overflow path 14 and extends therefrom into communication with the branch secondary delivery conveyor 12 at an infeed position 15'. This relatively shorter cop return conveyor 15 provides a storage location for caddies 2 which were not transferred to a winding head 19 along the last section of the distributing path 13, i.e., downstream of the last infeed position 12'. An openable and closable shunt 17 is located at the intersection of the overflow path 14, the main cop return conveyor 23 and the secondary conveyor 15 and is connected to the central control unit 21 to selectively control the delivery of excess caddies 2 alternatingly to the return conveyors 15 or 23. The number of excess caddies 2 can be determined in a time-related manner in the central control unit 21 with the aid of a sensor 16 disposed along the overflow path 14 in advance of the shunt 17 and also connected to the control unit 21. As a result, if the number of circulating caddies 2 becomes too great in the last section of the distributing path, i.e., downstream of the last infeed position 12', this circuit can be relieved by opening shunt 17 so that caddies 2 are conveyed and to and along the main return conveyor 23 to return as above described back to the beginning of the main conveyor 5. As an alternative to the sensor 16, the monitoring of caddies 2 returned within the circuit in the last section of distributing path 13 can be accomplished by means of a sensor 22 located along the secondary cop return conveyor 15. This sensor 22 thus counts only the caddies 2 actually transported on the secondary return conveyor 15.

Figure 3:
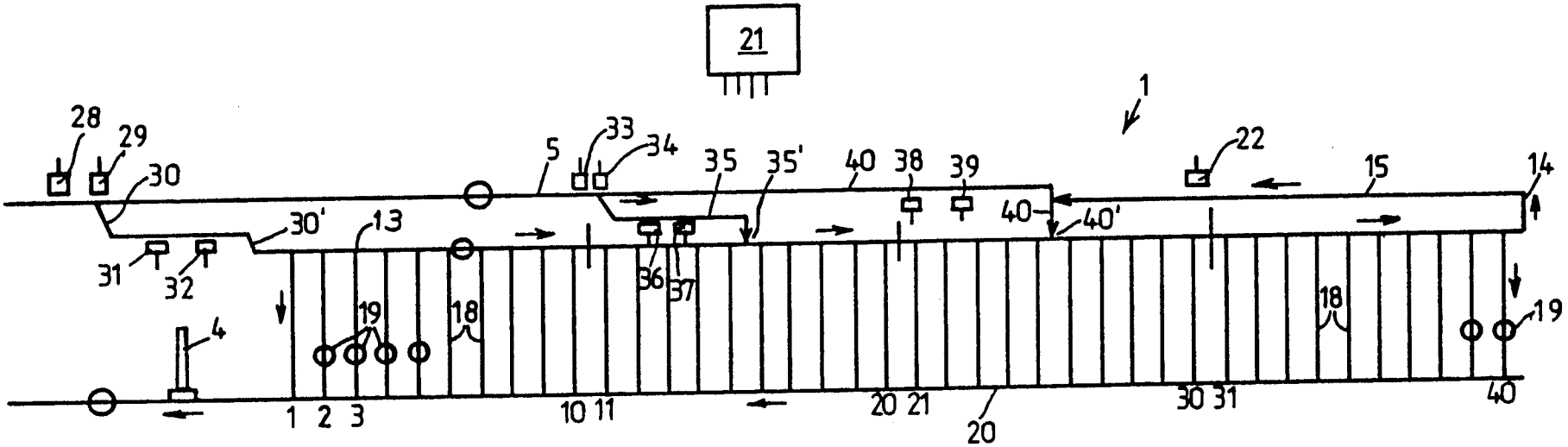
FIG. 3 shows another schematic plan view, similar to FIG. 1, of a bobbin winding machine equipped with a cop supplying apparatus according to another preferred embodiment of the present invention.

In the embodiment of the invention shown in FIG. 3, the main return conveyor 23 which returns cop-mounted caddies 2 to the beginning of the main delivery conveyor 5 has been eliminated, avoiding additional complexity and reducing the structural space required which in turn can be used for more machinery.

Shunts 29 and 34 are provided in this embodiment at the locations at which secondary delivery conveyors 30,35 branch from the main delivery conveyor 5, which shunts are controlled by the central control unit 21. Likewise, sensors 28,33 are located along the main delivery conveyor 5 upstream of the shunts 29,34 in order to recognize the passage of caddies 2 mounted with cops 3 and to signal each caddy passage to the central control unit 21.

As is also apparent from FIG. 3, the spacings between the infeed positions 30',35' and between the infeed positions 35',40' as well as the spacing between the infeed position 40' and the terminal end of the distributing path 13 are different and encompass differing numbers of winding heads 19. Accordingly, the distribution path of the caddies to the secondary branch conveyors 30,35,40 should be controlled correspondingly to the number of winding heads 19 served by each infeed position, i.e., three caddies to each of the infeed positions 30' and 40' for every two caddies to the infeed position 35'. This distribution ratio can be readily stored in the central control unit 21 to form the basis for controlling of the shunts 29 and 34.

Since the full-length cop return conveyor 23 was eliminated in the embodiment of the invention shown in FIG. 3, as has already been explained, remedial measures must be possible if too many caddies circulate in the last section of the distributing path 13 downstream of the last infeed position 40'. For this purpose, a sensor 22 is provided along the cop return conveyor 15 and is connected to the time-related counting circuit in the central control unit 21 by which a temporary correction of the distribution of caddies can be accomplished by control of shunts 29,34 to shunt more caddies over a predetermined time period into the particular secondary branch delivery conveyor 30 and/or 35 than is the case in normal operation. This corrective operation is turn reduces the supply of caddies into the branch delivery conveyor 40, as a result of which the excess caddies 2 circulating along return conveyor 15 are used up relatively rapidly.

Cop preparation units 31,32; 36,37; 38,39 are located at each of the three branch delivery conveyors 30,35,40. Each pair of these cop preparation units 31,32 and 36,37, as well as 38,39 serve different preparatory steps, as is described in German Patent Document DE 39 19 526 A1.

The arrangement of the cop preparation units at all of the branch delivery conveyors assures a sufficient supply of cops 3 to the entire automatic bobbin winder 1, which is particularly necessary or desirable if relatively small cops with short cop unwinding times are being processed. If the automatic bobbin winder has a great number of winding heads, a single cop preparation device would not be able to sufficiently supply the entire automatic bobbin winder with fresh cops 3. The cycle time for preparing each cop would have to be reduced so greatly in the single cop preparation device that the rate of successful cop preparation would be greatly reduced and, in turn, the automatic bobbin winder would no longer be able to be operated effectively.

The arrangement of the main and branch delivery conveyors in accordance with the present invention distributes cop-mounted caddies to the winding heads of the automatic bobbin winder with sufficient uniformity to assure a rapid start-up of all winding heads, especially in the initiation of a winding operation, i.e., at the beginning of a winding batch, in contrast to known systems for supplying winders with cops wherein, for a significant time after a batch start, only the most upstream winding heads nearest the delivery end of the winder are supplied with cops. In particular, in the present invention, cops supplied to the distributing path 13 at the second and subsequent infeed locations cannot be received by the winding heads at the upstream end of the bobbin winding machine. In addition, the transport speed of the cop-mounted caddies on the main delivery conveyor 5 can be selected to be considerably greater than is possible on the distributing path 13, which results in an accelerated supply of cop-mounted carriers and avoids unnecessary storage of caddies. The total number of circulating caddies can be reduced in this manner. Further, in this connection, it is normally sufficient that the transverse storage paths 18 are dimensioned to receive only two waiting caddies in addition to the caddy supporting a cop at the actual unwinding position of the winding head.

It is also contemplated within the scope of the present invention to put one or several of the branch delivery conveyors out of operation if relatively large cops which have an relatively long unwinding time, e.g., of three or more minutes, are being rewound in the bobbin winding machine. Cops of this size would sufficiently reduce the requirement for fresh cops that a distribution of cops by means of three or more branch delivery conveyors is not necessary. The deactuation of a branch delivery conveyor can be accomplished in a simple manner by deactuating the shunt located at the entrance of the particular branch delivery conveyor so that the deactuated shunt then permits all caddies to freely pass along the main delivery conveyor to be conveyed further therealong. The deactuation of the last branch delivery conveyor, on the other hand, would be accomplished by actuating the shunt located at its entrance to remain pivoted into the main delivery conveyor to divert all arriving caddies to the preceding branch delivery conveyor.

Whereas the first branch delivery conveyor 8 or 30 branching from the main delivery conveyor 5 must connect with the distributing path 13 upstream of the first winding head, the last branch delivery conveyor 12 or 40 should connect with the distributing path at a location which is upstream of the terminal end of the main delivery conveyor 5 by an appropriate number of winding heads. It is to be expected in most cases that this section should encompass at least eight winding heads. As has already been explained, the cop requirement is especially great when small cops with relative short rewinding times are being processed. In such cases, if the last infeed position along the distributing path is located too close to the end of distributing path, the effectiveness of the last infeed position is questionable and it would be expected that a large number of caddies 2 entering the distributing path 13 at this infeed position will be returned along the cop return conveyor for redistribution. Otherwise, this last branch delivery conveyor would have to be supplied with only a very few caddies 2.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In an apparatus for supplying cops mounted upstanding on carriers to a plurality of winding heads of an automatic bobbin winder, said apparatus comprising a cop carrier distributing means forming a continuous transport section common to all said winding heads, said distributing means including a conveyor belt, said winding heads being communicated with said distributing means by a plurality of cop carrier storage paths extending between said cop carrier distributing means and said winding heads, each said storage path being adapted for receiving a predetermined number of cop carriers and to prevent receipt of additional carriers when full whereby additional carriers continue transportation on said distributing means, and a cop carrier return means communicated with a terminal end of said distributing means for return transport of cop carriers not received by said storage paths for said winding heads in the opposite direction to the direction of transport of said distributing means and for feeding said returned cop carriers back to said distributing means at an upstream location, the improvement comprising a main cop carrier delivery means extending parallel to said distributing means and a plurality of secondary delivery means branching from said main delivery means to said distributing means at respective infeed positions spaced along said distributing means, a first said infeed position being located in relation to the direction of transport of said conveyor belt of said distributing means upstream of a first one of said winding heads and a last one of said infeed positions being located upstream of a last group of said winding heads.

2. The cop supplying apparatus according to claim 1, wherein said main cop carrier delivery means is arranged for transport of cop carriers thereon in a direction corresponding to the direction of transport of said conveyor belt of said distributing means.

3. The cop supplying apparatus according to claim 1 and further comprising sensing means and shunting means associated with at least one of said secondary delivery means for selectively directing carriers onto said secondary delivery means or preventing carriers from being received by said secondary delivery means in predetermined numbers for uniform distribution of said carriers to said distributing means.

4. The cop supplying apparatus according to claim 1, wherein said return means is communicated with said main delivery means at a location upstream of a first one of said secondary delivery means.

5. The cop supplying apparatus according to claim 1 wherein said return means is communicated with a last one of said secondary delivery means.

6. The cop supplying apparatus according to claim 1 and further comprising a central control unit, sensing means associated with said return means for recognizing the passage of carriers and signalling said central control unit, said central control unit having a circuit for counting passing carriers in relation to elapsed time.

7. The cop supplying apparatus according to claim 6 wherein said return means is communicated with said main delivery means at a location upstream of a first one of said secondary delivery means and with a last one of said secondary delivery means, and further comprising an openable and closable shunting means disposed to selectively shunt carriers from said return means to said main delivery means upstream of said first secondary delivery means or to said last secondary delivery means, said shunting means being associated with said central control unit to open when a predetermined value of said time-related counting circuit is exceeded.

8. The cop supplying apparatus according to claim 3 and further comprising a central control unit, sensing means associated with said return means for recognizing the passage of carriers and signalling said central control unit, said central control unit having a circuit for counting passing carriers in relation to elapsed time, and a circuit for controlling switching of said shunting means to supply relatively fewer carriers to a last one of said secondary delivery means when a predetermined value of said time-related counting circuit is exceeded.

9. The cop supplying apparatus according to claim 1 and further comprising cop preparation units located at said secondary delivery means.

* * * * *